US005101792A

United States Patent [19]

Koch

[11] Patent Number: 5,101,792

[45] Date of Patent: Apr. 7, 1992

[54] INTERNAL COMBUSTION ENGINE FUEL DISTRIBUTOR HOUSING

[75] Inventor: Alfred Koch, Weissach, Fed. Rep. of Germany

[73] Assignee: Dr. Ing. h.c.F. Porsche, AG, Fed. Rep. of Germany

[21] Appl. No.: 599,984

[22] Filed: Oct. 19, 1990

[30] Foreign Application Priority Data

Oct. 20, 1989 [DE] Fed. Rep. of Germany ..... 3934906

[51] Int. Cl.[5] ..... F02M 35/10; F02M 55/00

[52] U.S. Cl. ..... 123/456; 123/52 MV

[58] Field of Search ..... 123/52 M, 52 MV, 432, 123/456, 468, 469, 470, 472

[56] References Cited

U.S. PATENT DOCUMENTS

| | | | |
|---|---|---|---|
| 4,556,034 | 12/1985 | Anklam et al. | 123/470 |
| 4,576,131 | 3/1986 | Sugiyama . | |
| 4,643,137 | 2/1987 | Choushi et al. | 123/52 M |
| 4,702,203 | 10/1987 | Ohmi et al. | 123/432 |
| 4,768,487 | 9/1988 | Yamamoto et al. . | |
| 4,981,115 | 1/1991 | Okasako et al. | 123/52 MV |

FOREIGN PATENT DOCUMENTS

| | | |
|---|---|---|
| 0102164 | 5/1987 | European Pat. Off. . |
| 0102169 | 9/1987 | European Pat. Off. . |
| 0245009 | 11/1987 | European Pat. Off. . |
| 0261855 | 3/1988 | European Pat. Off. . |
| 0294083 | 12/1988 | European Pat. Off. . |
| 0306739 | 3/1989 | European Pat. Off. . |
| 0314074 | 5/1989 | European Pat. Off. . |

*Primary Examiner*—E. Rollins Cross
*Assistant Examiner*—Thomas N. Moulis
*Attorney, Agent, or Firm*—Evenson, Wands, Edwards, Lenahan & McKeown

[57] ABSTRACT

The bottom part of an air collector of an internal-combustion engine is also constructed as a fuel distributor housing. All fuel-feeding and fuel-removing pipes, etc., together with injection valves and sections of the suction pipes which can be blocked by pivoted flaps, are integrated into the fuel distributor housing. The fuel distributor housing can be manufactured as a sand-cast or diecast metal part or as a plastic part.

12 Claims, 5 Drawing Sheets

INTERNAL COMBUSTION ENGINE FUEL DISTRIBUTOR HOUSING

BACKGROUND AND SUMMARY OF THE INVENTION

The invention relates to a fuel distributor housing and, more particularly, to a fuel distributor housing for an internal-combustion engine having a V-shaped cylinder arrangement, a forward flow device for the feeding and a return flow device for the removal of fuel and having receiving devices for injection valves. The fuel distributor housing extends along the internal-combustion engine which has an air collector in which first and second sections of suction pipes having throttling elements are arranged. The suction pipes carry an air current from the air collector to the intake ducts in the cylinder head of the internal-combustion engine, with injection valves assigned to the two sections of the suction pipes.

U.S. Pat. No. 4,576,131 shows an intake system for an air-fuel mixture of an internal-combustion engine which has two inlet valves for each cylinder. In this case, one intake pipe respectively leads from an air collector to each cylinder. Directly before entering the cylinder head, each intake pipe is divided into two sections which extend in parallel and lead to the two intake valves of each cylinder. A throttle valve is arranged in one or in both sections, respectively. A fuel line which extends along the internal-combustion engine is arranged on the outside and separately from the air collector. An injection valve for each cylinder is arranged at the fuel line which leads into the intake pipe in front of the division into the two sections.

In the EP-0102169, an intake system for an air-fuel mixture of an internal-combustion engine is shown in which a cast profile is arranged in the V-portion of crossing intake pipes. Lines extend inside this profile for the feeding and removal of fuel to individual injection valves which are assigned to the cylinders of the internal-combustion engine. The profile is screwed to the intake pipes as a separate component.

It is an object of the present invention to provide a compact fuel distributor housing which optimally utilizes the available space, can be manufactured easily and at low cost and permits a time-saving and cost-saving mounting.

This object has been achieved by a fuel distributor housing which forms a bottom part for an air collector and has second sections of the suction pipes constructed as ducts which are arranged between the top side and the bottom side of the fuel distributor housing transversely with respect to the forward flow device and to the return flow device 16 and can be blocked off by throttling elements. The ducts, combined in parallel extending rows, form the outer longitudinally extending boundaries of the fuel distributor housing; and the forward flow device, the return flow device and the receiving devices are arranged parallel between rows in which the ducts are combined.

In particular, the fuel distributor housing according to the present invention is constructed as the bottom part of an air collector and advantageously integrates sections extending in the form of ducts of the suction pipes extending to the intake ducts arranged in the cylinder head, throttle elements for the blocking of these ducts, all lines required for the feeding and the removal of fuel as well as receiving devices for injection valves which can be inserted into the fuel distributor housing.

The fuel distributor housing of the present invention has a compact shape and is arranged particularly advantageously in the space existing in the V portion of an internal-combustion engine with a V-shaped cylinder arrangement. The ducts which extend perpendicularly between the top side facing the top part of the air collector and the bottom side of the fuel distributor housing are combined in two rows which form the outer boundaries of the fuel distributor housing extending in the longitudinal course. A forward flow device used for the supply of fuel extends in the center between the rows and in parallel to them adjacent to the bottom side. One return flow device respectively for the removal of fuel extends on both sides at the same distance from the forward flow device and adjacent to the top side and is assigned to one row respectively.

The forward flow device and the return flow device are each connected with one another by way of a plane rib into which the receiving devices for the injection valves are integrated. The fuel distributor housing therefore has a V-shaped cross-section between the perpendicular rows of the ducts, and optimally utilizes the space existing between the rows.

The V-shaped design and an additional ribbing mounted on the top side and the bottom side renders the fuel distributor housing insensitive to the thermally caused mechanical tensions in the V-portion of the internal-combustion engine.

The integration of the injection valves operating at a high frequency in a central area of a rigid housing markedly reduces the sound radiation.

According to another aspect of the present invention, the two rows are longitudinally offset with respect to one another corresponding to the offsetting of the two cylinder banks of an internal-combustion V-engine. The area created by the longitudinal offsetting, on one end of the fuel distributor housing, is utilized by a holding device for a fuel pressure regulator.

The fuel distributor housing is cooled by the fuel amount which flows twice along its longitudinal course through the forward flow device and the return flow device. The fuel distributor housing according to the present invention makes superfluous the separate components which are normally used for the supply and the removal of fuel as well as their fastening elements. In addition, the fuel distributor housing can be mass produced in one machinable piece as a lightweight, sandcast or diecast part made of aluminum which is easy to mount. Before the mounting, the fuel distributor housing may be subjected to a leak test while it is completely equipped. Expenditures are therefore avoided from the start which normally occur during the touch-up as a result of dismounting and mounting.

For a further weight reduction or when fuel qualities such as to be harmful to aluminum, the entire fuel distributor housing may also be manufactured of plastic.

BRIEF DESCRIPTION OF THE DRAWINGS

These and other objects, features and advantages of the present invention will become more apparent from the following detailed description of a presently preferred embodiment when taken in conjunction with the accompanying drawings therein.

DETAILED DESCRIPTION OF THE DRAWINGS

Figure 1:
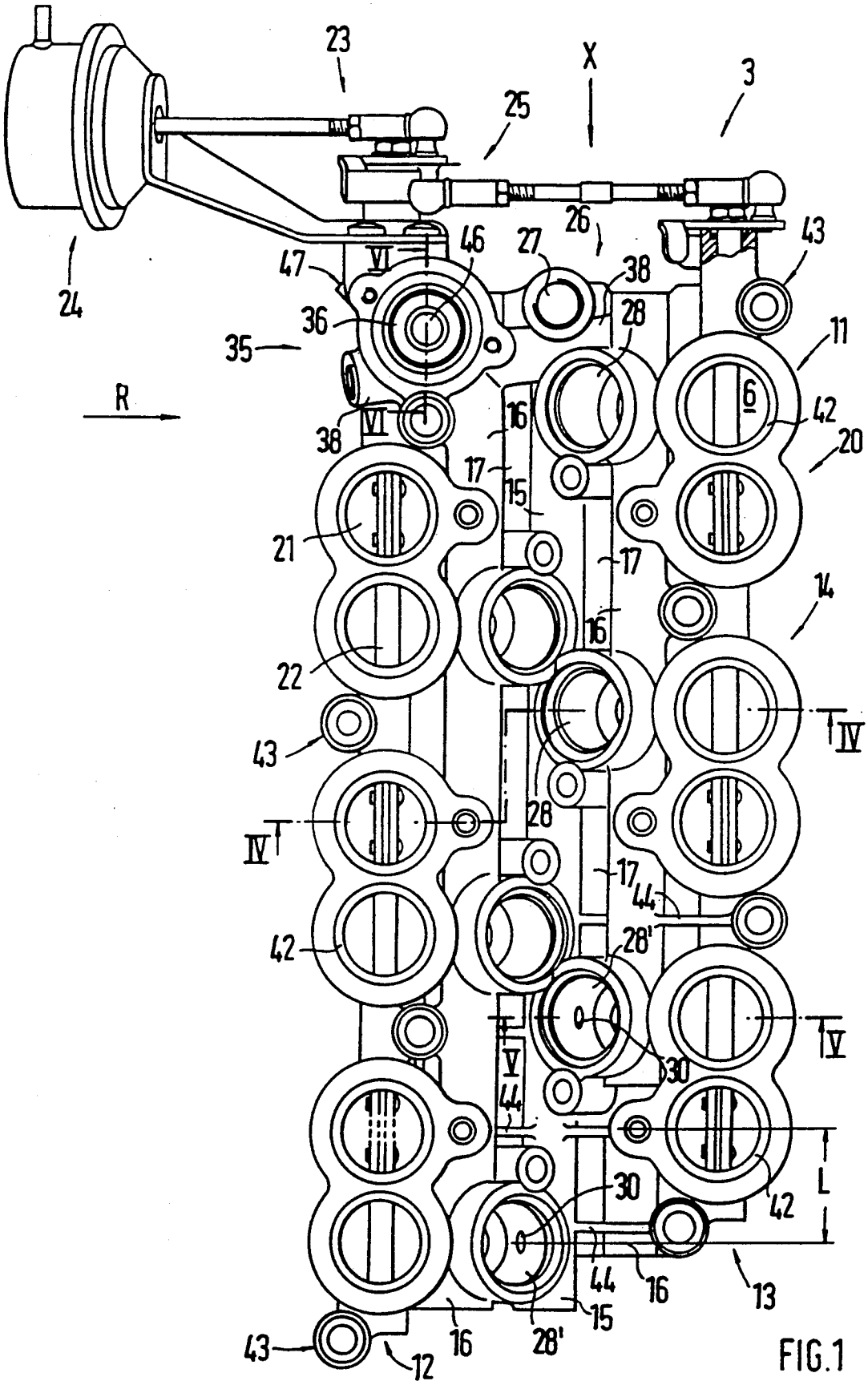
FIG. 1 is a top plan view of a fuel distributor housing in accordance with the present invention.
Figure 4:
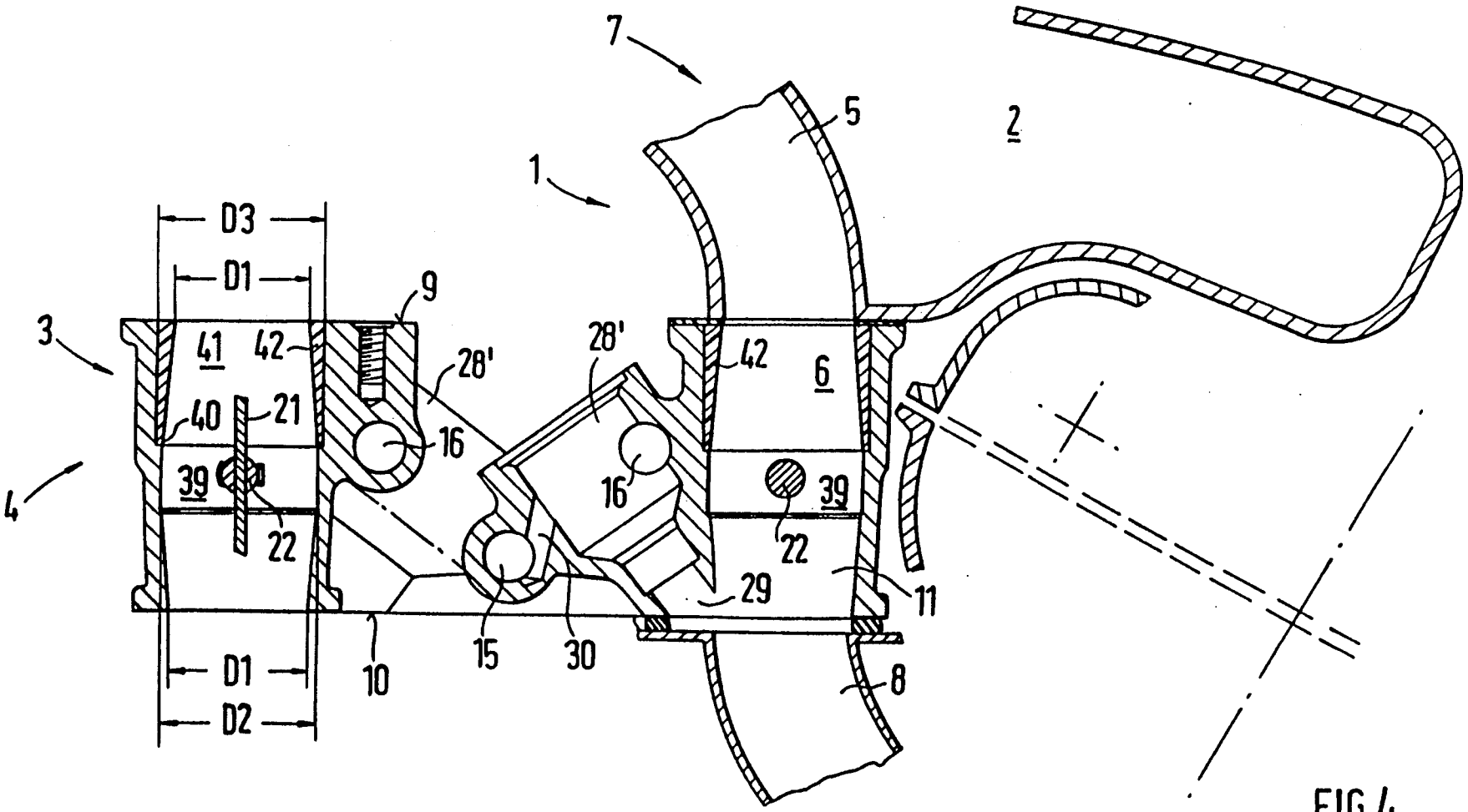
FIG. 4 is a sectional view along Line IV—IV according to FIG. 1.

As shown most clearly in FIG. 4, an air collector 1 of a 6-cylinder internal-combustion V-engine having four valves for each cylinder comprises a top part 2 which is only outlined and a bottom part 4 which at the same time operates as a fuel distributor housing 3. Suction lines 7 comprising first sections 5 and second sections 6 guide an air current out of the top part 2 to the intake valves 8 arranged in the cylinder heads. The second sections 6 extend in the fuel distributor housing 3 between its top side 9 and its bottom side 10 as ducts 11. These ducts 11 are combined in rows 12, 13 extending in parallel with respect to one another as shown in FIG. 1, the rows 12, 13 forming the outer longitudinally extending boundaries 14 of the fuel distributor housing 3. A forward flow device 15 serving as a fuel supply extends centrally between the rows 12, 13 and narrowly adjacent to the bottom side 10. A return flow device 16 for the removal of fuel extends on both sides at the same distance from the forward flow device 15 and adjacent to the top side 9. A plane rib 17 extends between each return flow device 16 and the forward flow device 15 along the fuel distributor housing 3.

The fuel distributor housing 3 therefore has an M-shaped configuration transversely to its longitudinal course or direction by virtue of the rows 12, 13 which are disposed perpendicularly as the boundary and the ribs 17 which are arranged V-shape with respect to one another in between them.

Figure 2:
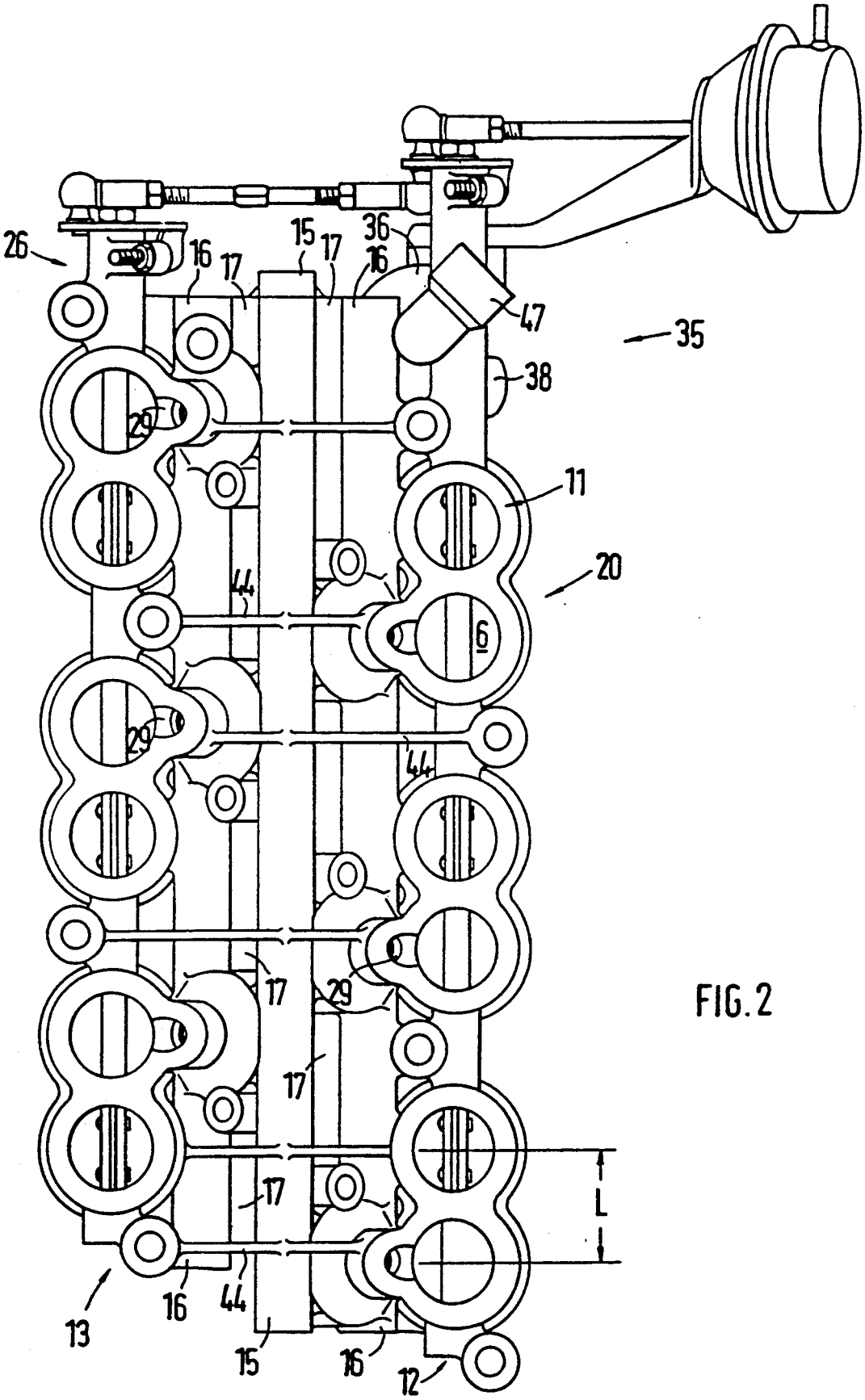
FIG. 2 is a bottom plan view of the fuel distributor housing shown in FIG. 1.

Along the rows 12, 13, two ducts 11 are combined in pairs to a total of three pairs 20, each pair 20 respectively being assigned to a cylinder of the internal-combustion engine. Because of the offsetting of the two cylinder banks in the longitudinal direction of the internal-combustion engine, the rows 12, 13 have a longitudinal offset L with respect to the longitudinal course of the fuel distributor housing 3, as illustrated in FIG. 1 and 2. The longitudinal offset L corresponds approximately to the outer diameter DA of a duct 11.

One duct 11 respectively of a pair 20 can be blocked off by way of a pivoted flap 21 for the control of the air current guided to the intake ducts 8. The pivoted flaps 21 of each row 12, 13 are arranged on a common shaft 22. The shafts 22 centrally penetrate all ducts 11 of the rows 12, 13. The adjustment of all pivoted flaps 21 takes place synchronously in a known manner by an actuating mechanism 23, comprising a pressure element 24 and a linkage 25, (which will not be discussed in detail) and which is fastened to one end 26 of the fuel distributor housing 3.

The feeding of fuel takes place through a bore 27 at the end 26 of the fuel distributor housing 3. The bore 27 extends perpendicularly from above the housing into the forward flow device 15. A receiving device 28 for an injection valve is assigned to each duct pair 20; these receiving devices 28 penetrate the ribs 17 almost perpendicularly and, via a lower opening 29, as shown in FIGS. 2 and 4, lead obliquely in the area of the bottom side 10 into the duct 11 of the pair 20 which has no pivoted flap 21. The two receiving devices 28', which are adjacent to the side opposite the end 26, are connected with the forward flow device 15 by short bores 30 extending perpendicularly with respect to the forward flow device 15 as seen in FIGS. 1 and 4. The receiving devices 28 are arranged with respect to the return flow devices 16 in such a manner that each return flow device 16 tangentially intersects the receiving devices 28 of one row 12, 13, as illustrated in FIG. 4.

Figure 3:
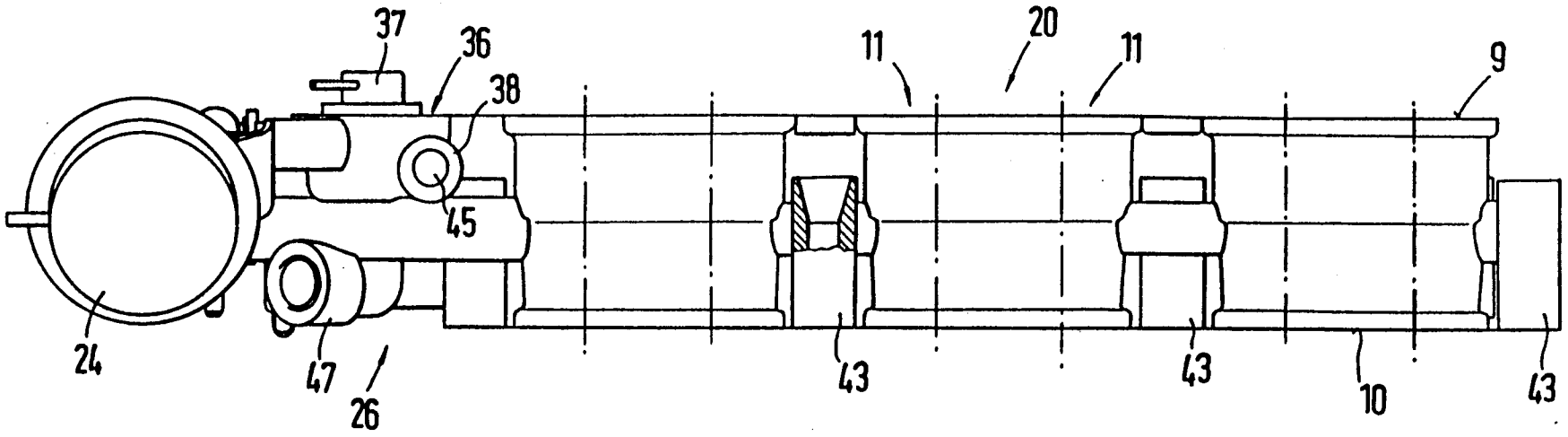
FIG. 3 is a side elevational view in the direction of the arrow "R" in FIG. 1.
Figure 6:
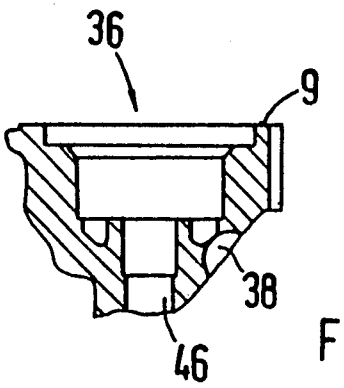
FIG. 6 is a sectional view along Line VI—VI according to FIG. 1.
Figure 5:
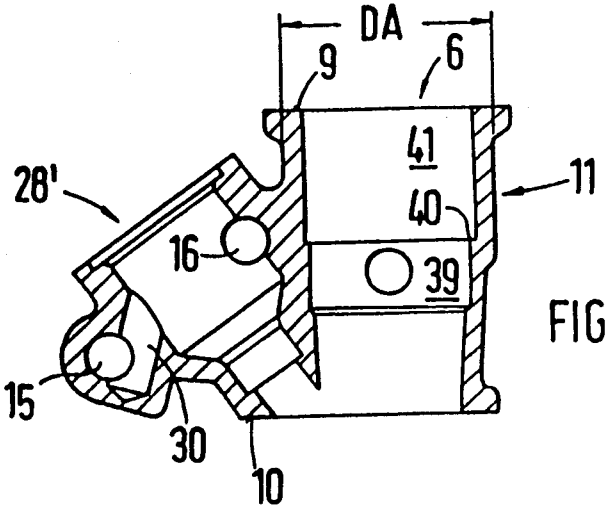
FIG. 5 is a sectional view along Line V—V according to FIG. 1.
Figure 7:
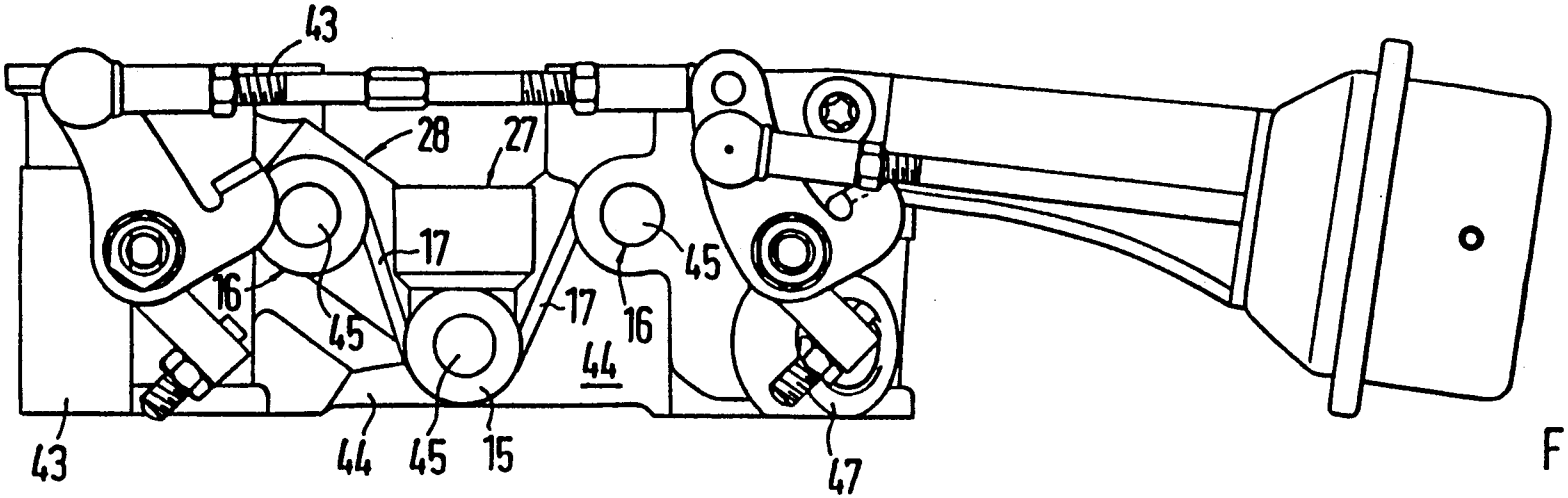
FIG. 7 is an end elevational view in the direction of arrow "X" in FIG. 1.

In an area 35 created at the end 26 of the fuel distributor housing 3 by the longitudinal offset L, a perpendicularly extending holding device 36 for a fuel pressure regulator 37 (FIG. 3) is arranged in the row 12. A line 38 which is constructed as a bore and extends essentially transversely in the fuel distributor housing 3 is arranged such that it connects both return flow devices 16 and the holding device 36 with one another. In this illustrated embodiment, the line 38 intersects the holding device 36 tangentially (FIG. 6).

As further illustrated in FIG. 4, the inside contour of the ducts 11 widens conically from a first diameter D1 located in the bottom side 10 in the direction toward the top side 9 to a diameter D2. Following that, the inside contour has a cylindrical area 39 with the diameter D2 which, in the center, is penetrated by the shaft 22. Above the area 39, the inside contour, by way of a step 40, widens to a cylindrical section 41 with a diameter D3 which leads to the top side 9.

The widening of the ducts 11 in the area of the shafts 22 is required in order to compensate for the cross-sectional surface of the ducts 11 which otherwise is reduced by the shafts 22. A bush 42 is inserted into the section 41 which supports itself on the step 40 and the cylindrical outer surface of which has the diameter D3. The conical interior surface of the bush 42 widens from the diameter D1 located in the top side 9 to the diameter D2 of area 39.

By the use of the bushes 42, a configuration of the inside contour of the ducts 11 is possible that is appropriate for the casting, and the required widening of the diameter of sections 41 from D1 to D2 does not have to take place by means of an expensive conical design.

Along the rows 12, 13, channels 43 for receiving screws are cast on the fuel distributor housing 3 for fastening the fuel distributor housing 3 to the internal-combustion engine. Between the rows 12, 13 on the top side 9 and on the bottom side 10, transversely extending ribs 44 are arranged for the stiffening of the fuel distributor housing 3. The fuel distributor housing 3 is manufactured in one piece in a sand-casting or diecasting process and can be automatically machined in a few steps. The ends of the forward flow and return flow devices 15, 16, of the bores for the shafts 22 as well as of the line 38 which are open after the boring are closed off by stoppers 45.

During the operation of the internal-combustion engine, an air current is sucked by the cylinders of the internal-combustion engine from the top part 2 of the air collector 1, by way of the first sections 5 of the suction pipes 7 and the second sections 6 in the fuel distributor housing 3 and from there by means of the intake ducts 8, into the combustion chambers of the cylinders.

Although the invention has been described and illustrated in detail, it is to be clearly understood that the same is by way of illustration and example, and is not to be taken by way of limitation. The spirit and scope of the present invention are to be limited only by the terms of the appended claims.

It is claimed:

1. A fuel distributor housing extending along an internal-combustion engine which has an air collector, particularly an engine having a V-shaped cylinder arrangement, a forward flow device for feeding fuel, a return flow device for removing fuel and receiving devices for injection valves, first and second sections of suction pipes having throttling elements arranged in the air collector, such that the suction pipes carry an air current from the air collector to intake ducts in cylinder heads of the internal-combustion engine, and the injection valves being operatively associated with the second sections of the suction pipes, wherein the fuel distributor housing forms a bottom part for the air collector and the second sections of the suction pipes are constructed as ducts arranged between a top side and a bottom side of the fuel distributor housing transversely with respect to the forward flow device and to the return flow device so as to be blocked off by the throttling elements, and which, combined in parallel extending rows, form outer longitudinally extending boundaries of the fuel distributor housing, and the forward flow device, the return flow device and the receiving devices are arranged in parallel between the parallel extending rows.

2. The fuel distributor housing according to claim 1, wherein, in the center between the parallel extending rows, the forward flow device is narrowly adjacent the bottom side and on both sides of the housing at the same distance from the forward flow device and adjacent to the top side, one return flow device, respectively, is associated with one of the rows, the return flow devices, by way of plane ribs, being connected with the forward flow device in such a manner that the fuel distributor housing has an essentially V-shaped design transversely to its longitudinal direction between the parallel extending rows.

3. The fuel distributor housing according to claim 1, wherein two ducts, respectively, along the rows form a pair associated with a cylinder of the internal-combustion engine and extend along the rows.

4. The fuel distributor housing according to claim 3, wherein at least one duct of each pair can be blocked by a pivoted flap acting as the throttling element, and each pivoted flaps is fastened on shafts arranged parallel with respect to the forward flow device and penetrating each duct of one row.

5. The fuel distributor housing according to claim 4, wherein at least one of the receiving devices is associated with each pair of ducts, the receiving devices penetrating the ribs almost perpendicularly, and lower openings of the receiving devices, in the area of the bottom side, leading into the ducts.

6. The fuel distributor housing according to claim 1, wherein one of the rows has a longitudinal offset with respect to the other of the rows, the offset corresponding approximately to an outer diameter of a duct.

7. The fuel distributor housing according to claim 6, wherein a holding device for a fuel pressure regulator is arranged at one end of the fuel distributor housing in an area created by the longitudinal offset.

8. The fuel distributor housing according to claim 7, wherein a line extending adjacent to the end substantially transversely in the fuel distributor housing is arranged it to connect the return flow devices and the holding device with each other.

9. The fuel distributor housing according to claim 1, wherein the forward flow device and the return flow device are bores, the return flow device being arranged to intersect the receiving devices tangentially, and the forward flow device being connected with the receiving devices by short bores which extend perpendicularly with respect to the forward flow device.

10. The fuel distributor housing according to claim 4, wherein an inside contour of the ducts widens conically, from a first diameter located in the bottom side, in the direction of the top side followed with a cylindrical area having a second diameter which is penetrated by the shaft, and again widening up to the top side as a cylindrical section with a third diameter.

11. The fuel distributor housing according to claim 10, wherein a bush is inserted in the cylindrical section of the duct, a cylindrical outer surface of the bush having the third diameter, and the conical interior surface of which widening, from the first diameter located in the top side, to the second diameter bordering the cylindrical area.

12. A method for making a fuel distributor housing extending along an internal-combustion engine which has an air collector, particularly an engine having a V-shaped cylinder arrangement, a forward flow device for feeding fuel, a return flow device for removing fuel and receiving devices for injection valves, first and second sections of suction pipes having throttling elements arranged in the air collector, such that the suction pipes carry an air current from the air collector to intake ducts in cylinder heads of the internal-combustion engine, and the injection valves being operatively associated with the second sections of the suction pipes comprising the steps of:

forming an inside contour of the ducts so as to widen conically from a first diameter located in the bottom side, in the direction of the top side, followed by a cylindrical area having a second diameter which is penetrated by a shaft to which pivoted flaps are connected, and again widening up to the top side as a cylindrical section with a third diameter, and inserting a bush in the cylindrical section, with a cylindrical outer surface of the bush widens from the first diameter located in the top side to the second diameter bordering the cylindrical area.

* * * * *